US007390228B2

(12) United States Patent
Rimke

(10) Patent No.: US 7,390,228 B2
(45) Date of Patent: Jun. 24, 2008

(54) CHAMBER HOUSING FOR FORMING AN ELECTRICAL PLUG-IN CONNECTION PART

(75) Inventor: Kersten Rimke, Herscheid (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 403 days.

(21) Appl. No.: 11/335,258

(22) Filed: Jan. 19, 2006

(65) Prior Publication Data

US 2006/0148331 A1 Jul. 6, 2006

Related U.S. Application Data

(63) Continuation of application No. PCT/EP2004/007825, filed on Jul. 15, 2004.

(30) Foreign Application Priority Data

Jul. 19, 2003 (DE) ..... 103 32 892

(51) Int. Cl.
*H01R 13/514* (2006.01)

(52) U.S. Cl. ..... 439/752; 439/595

(58) Field of Classification Search ..... 439/595, 439/752, 871

See application file for complete search history.

(56) References Cited

U.S. PATENT DOCUMENTS 4,045,110 A 8/1977 Sterken
5,122,080 A * 6/1992 Hatagishi et al. ..... 439/595
6,045,404 A 4/2000 Myer
6,152,783 A 11/2000 Tsuchiya
6,478,620 B1 11/2002 Bonavita et al.
6,482,047 B1 * 11/2002 Lytle et al. ..... 439/752
2002/0031947 A1 3/2002 Gundermann et al.
2002/0076992 A1 6/2002 Kurimoto et al.
2002/0168904 A1 * 11/2002 Lytle, Jr. et al. ..... 439/752

FOREIGN PATENT DOCUMENTS

FR 27 47 846 10/1997

* cited by examiner

*Primary Examiner*—Tho D. Ta
*Assistant Examiner*—Travis Chambers
(74) *Attorney, Agent, or Firm*—Brooks Kushman P.C.

(57) ABSTRACT

A chamber housing of an electrical plug-and-socket connector includes rows of chambers which open onto a front housing side to receive elements. Springs respectively extend into the chambers for locking the elements. A slider channel extends along a middle row, connects with the middle row chambers, opens onto a transverse housing side, and borders the springs extending into the middle row chambers. A separation channel is arranged between each pair of adjacent springs extending into the middle row chambers. The separation channels extend along the longitudinal extension of the middle row chambers, open onto a front housing side, and intersect the slider channel. A blocking channel extends along the middle row, borders the springs extending into the middle row chambers, and opens onto the transverse housing side. A slider inserted through the blocking channel meets with the springs extending into the middle row chambers to Prevent buckling of these springs.

20 Claims, 3 Drawing Sheets

CHAMBER HOUSING FOR FORMING AN ELECTRICAL PLUG-IN CONNECTION PART

CROSS-REFERENCE TO RELATED APPLICATIONS

This is a continuation of International Application PCT/EP2004/007825, published in German, with an international filing date of Jul. 15, 2004, which claims priority to DE 103 32 892.0 filed Jul. 19, 2003, which are both hereby incorporated by reference.

BACKGROUND OF THE INVENTION

1. Field of the Invention

The invention relates to a chamber housing for forming an electrical plug-and-socket connector with chambers arranged in a plurality of parallel rows, each chamber intended to hold one electrical contact element and allowing the locking element of a contact spring integrally molded on the chamber housing to engage into the chamber for primary locking of a contact element that is inserted into the chamber, and each contact spring is secured against buckling by a blocking element.

2. Background Art

Such chamber housings are used in the automotive area, among other places, as a part to form electrical plug-and-socket connectors, for example, to make contact between electrical/electronic components contained in the engine compartment and the motor vehicle's electrical system. Generally, such plug-and-socket connectors have many pins, for example, 47, 58, 96, or even more than 150 pins. In such plug-and-socket connectors, the individual chambers to hold the electrical contact elements are arranged in a plurality of rows that are parallel to one another.

In one prior art plug-and-socket connector, primary locking of a contact element inserted into a chamber is provided by a locking element of a contact spring integrally molded on the chamber housing. For example, the locking element can be a hooked projection or the top edge of the contact spring. The chamber housings are injection-molded plastic parts such that the individual contact springs integrally molded on the chamber housings are also made of plastic. To ensure that the contact springs require sufficient withdrawal force to provide security from withdrawal, blocking elements are provided which border the contact springs on the back thus preventing a buckling motion.

In previously known chamber housings made with more than two rows and thus having interior or middle chamber rows that are inaccessible to mold slides from the long side of the chamber housing, the chamber housing is made in two parts, at least in the area of the middle rows, to allow the individual contact springs to be molded in an injection mold and removed from the mold using tool technology. In this previously known prior art, the one chamber housing part includes the chambers with the contact springs. The other chamber housing part carries the top of the chambers and the blocking elements that reach behind the contact springs. In this previously known chamber housing, the two-part design of at least those sections of the chamber housing with the middle rows is particularly disadvantageous, first because this requires the production of two parts to be connected with one another and second because this requires their assembly at a later point in time, and in the course of this the cumulative tolerances also increase.

SUMMARY OF THE INVENTION

Starting from the prior art which has been discussed, the invention therefore has the goal of further developing a chamber housing of the type mentioned at the beginning in such a way that it can be produced in a single part using an injection molding technique, even when the chamber housing includes middle chamber rows that are inaccessible from the long side.

This is accomplished by an inventive chamber housing in which:

- a chamber row has a slider channel that follows the longitudinal extension of the chamber row, connects the individual chambers of the chamber row, is open on at least one transverse side of the chamber housing, and borders the free ends of the contact springs of the chamber row; and
- arranged between each pair of adjacent contact springs, there is a separation channel extending parallel to the longitudinal extension of the chambers and opening onto the front side of the chamber housing, and crossing the slider channel;
- parallel to the slider channel, a blocking channel is provided that is bordered on one side by the back of the contact springs of the chamber row and is open on at least one transverse side; and
- the chamber housing is associated with a slider which can be inserted in the blocking channel that is open on the side as an element to block the contact springs against buckling.

The chamber housing has a slider channel that is open on at least one transverse side of the chamber housing and connects the individual chambers of a row in the longitudinal extension of the chamber housing. The slider channel borders the free ends of the individual contact springs projecting into the chambers. The individual contact springs are divided by separation channels which extend parallel to the longitudinal extension of the chambers, and one of which runs between every two adjacent chambers. Thus, the separation channels cross the slider channel and open onto the front side of the chamber housing provided for connection with a complementary chamber housing. The slider channel and the separation channels crossing the slider channel create hollow spaces in the chamber housing, which can have the mold tools of an injection mold inserted into them, without their having to be inserted in the transverse direction (the y direction), thus engaging into the long sides of the chamber housing. A mold tool keeping the slider channel clear is moved in the longitudinal direction (in the x direction), and the mold tools keeping the separation channels clear are moved in the direction of the longitudinal extension of the chambers (thus in the z direction). The form of the slider channel serves first to keep the free ends of the contact springs clear. The slider channel engaging into the chambers of such a chamber row can also be used to insert a blocking element after the chamber housing is equipped with contact elements, which provides a secondary locking, if the contact elements are appropriately designed.

Extending parallel to the slider channel is a blocking channel also open to a transverse side. The blocking channel extends along the backs of the contact springs. Thus, it is possible, by pushing in a blocking element—for example a strip—into the blocking channel from the side, to block the contact springs against buckling. It is expedient for the slider channel and the blocking channel to form a common channel so that a single mold tool can keep both these channels clear. Such a mold tool has openings in the line of the separation channels so that it is possible for another comb-like mold tool intended to keep the separation channels clear to be inserted in the z direction through the mold tool keeping the slider channel clear. It is expedient for the separation channels to be made wider in their upper section bordering the front side of the chamber housing than in the respective lower section bordering the slider channel.

First, making the upper sections of the separation channels wider has advantages in the design of mold tools with respect to the tool's stability, and second it has the advantage that the wider section of the separation channels simultaneously creates passability, in order to make available, from the front side and parallel to the actual chamber, access to the chamber and in particular to the contact springs projecting into such a chamber. This passability can be used in order to put a removal tool against a contact spring projecting into the chamber and locking a contact element, if this contact spring is supposed to be taken out of its primary locking position, for example, in order to make it possible to remove from the chamber a contact element that might have been misconnected.

For the case in which it is intended to provide secondary locking of the contact elements inserted into the chambers of the chamber row, and this secondary locking is not supposed to be done through the slider channel, there is another locking channel extending parallel to the slider channel and the blocking channel, which also engages into the chambers. Thus, in such an embodiment it is possible to push a locking strip in from the transverse side of the chamber housing into the locking channel after the individual chambers have been populated, in order to provide secondary locking of the contact elements inserted into the chambers. In such an embodiment, it is expedient for the locking channel to be connected with the blocking channel and with the slider channel, so that all that is needed is a single mold tool that can move in the x direction, in order to keep these three channels clear, and in order for it to be possible for this tool to be removed from the injection-molded chamber housing.

The described chamber row is one that is arranged between two other chamber rows. If the two other chamber rows each form one of the two outer chamber rows, it is also possible for the contact springs associated with these chamber rows to be formed and removed from the mold by mold tools that can move in the transverse direction (in the y direction). Nevertheless, it is also possible for these contact springs to be kept clear in the injection mold in the above-described manner. In any case, it is expedient for these chamber rows also to have a locking channel associated with them, which extends parallel to the above-described locking channel, for secondary locking. The individual locking strips to be inserted into these locking channels for secondary locking of the contact elements inserted into them can then be made as part of a fork-like slider, which is pushed onto the chamber housing from the side, after the chamber housing has been populated. It is expedient for this slider to be fixed in its pushed on position by latching it to the chamber housing.

BRIEF DESCRIPTION OF THE DRAWINGS

The invention is described below with reference to the attached figures which are based on a sample embodiment. The figures are as follows.

DETAILED DESCRIPTION OF THE PREFERRED EMBODIMENTS

Figure 1:
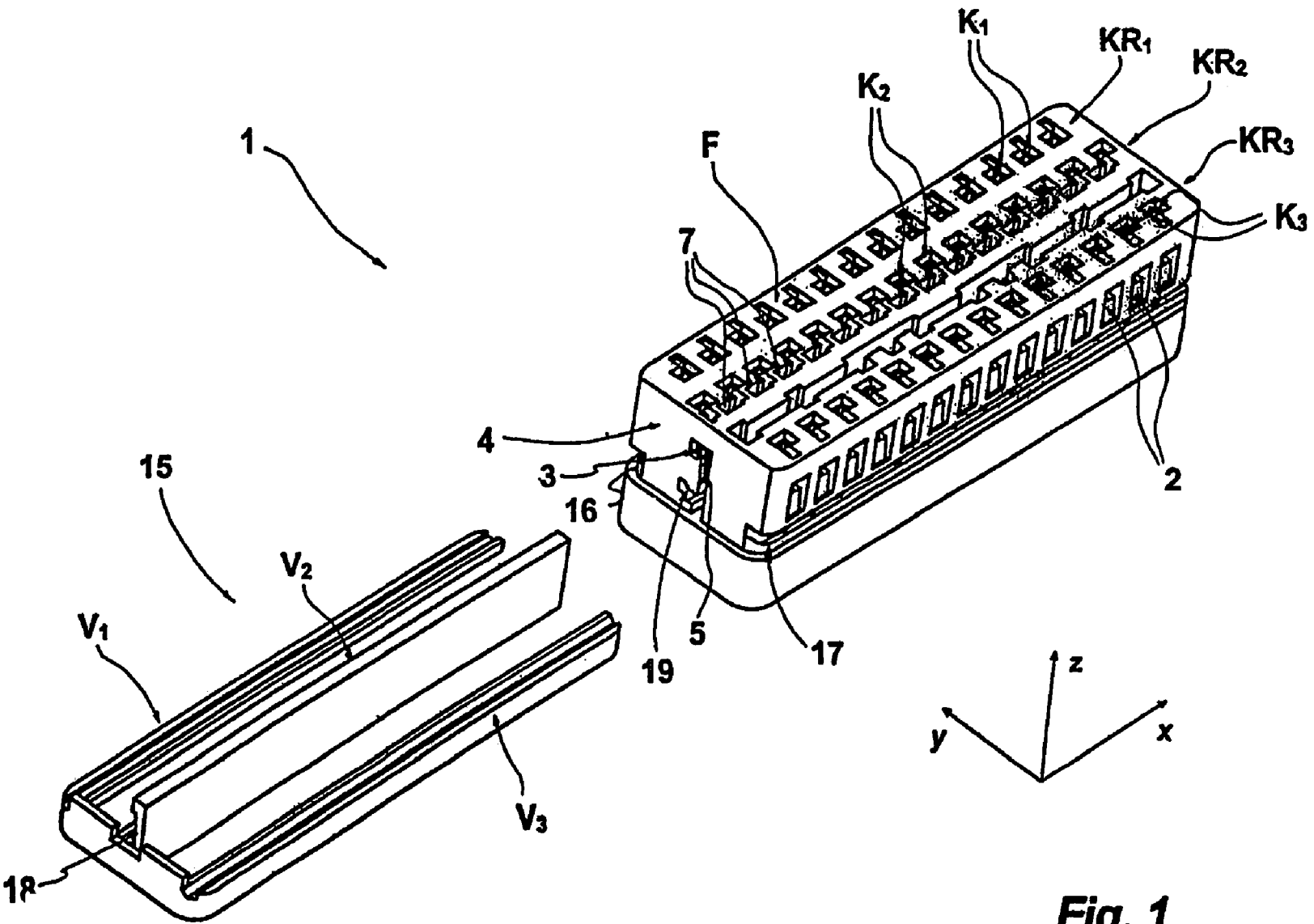
FIG. 1: is a perspective view of a chamber housing for forming an electrical plug-and-socket connector.

A chamber housing 1 is made as an injection-molded plastic part and serves for forming an electrical plug-and-socket connector. Chamber housing 1 serves to hold electrical contact elements, which can be engaged with complementary electrical contact elements of another plug-and-socket connector to create an electrical connection between them. In the sample embodiment shown, chamber housing 1 serves to form a female plug-and-socket connector. To hold the electrical contact elements (jacks), a number of chambers K1, K2, K3 are provided, a plurality of which are arranged in each chamber row KR1, KR2, KR3. Primary locking of the contact elements inserted into the individual chambers K1, K3 of the chamber rows KR1, KR3 is provided in each chamber by a contact spring 2 integrally molded on chamber housing 1. The backs of contact springs 2 of the chambers K3 of the chamber row KR3 can be seen in FIG. 1.

The individual chambers K1, K3 of the chamber rows KR1, KR3 are kept clear in an injection mold of the injected chamber housing 1, and can be removed from it, in a conventional manner. To accomplish this, suitable slider tools can move with respect to the injection mold in the y direction, and others in the z direction.

To make the middle chamber row KR2 with its contact springs, chamber housing 1 has channels extending in the z direction and in the x direction. These channels include a slider channel 3 and a blocking channel 5. Slider channel 3 encroaches into all chambers K2 of middle chamber row KR2 along the longitudinal extension of chamber housing 1. Slider channel 3 opens on at least one transverse side 4 of chamber housing 1, and thus is accessible over its entire cross-sectional surface from its transverse side 4. In the sample embodiment shown in the figures, slider channel 3 continues into blocking channel 5. Blocking channel 5 extends parallel to slider channel 3 and also opens on the transverse side 4 of chamber housing 1. Blocking channel 5 extends in the line of chamber row KR2. The cross-sectional surface of the common channel formed by slider channel 3 and blocking channel 5 is L-shaped with slider channel 3 forming the shorter leg of this common channel. Slider channel 3 separates contact springs 6 of chambers K2 of chamber row KR2 from the components of chamber housing 1 pointing toward the front side F of chamber housing 1 (see FIG. 2). Blocking channel 5 separates the backs of spring elements 6 from the sections of chamber housing 1 pointing toward chamber row KR3.

The individual contact springs 6 of chambers K2 of chamber row KR2 are separated by separation channels 7 that run in the z direction. Each pair of contact springs 6 arranged adjacent to one another (see FIG. 2) have one separation channel 7 apiece arranged between them. Separation channels 7 run in the z direction and thus parallel to the longitudinal extension of chambers K2 of chamber row KR2. After a first section 8, separation channels 7 open into slider channel 3, which extends transverse to the course of separation channel 7. Beneath slider channel 3, separation channels 7 continue in another section 9. Those sections 8 of separation channels 7 which are open to front side F of chamber housing 1 have a greater width in the x direction (the longitudinal extension) than do the continuing sections 9 beneath slider channel 3. Sections 9 separate the individual contact springs 6, each engaging in one chamber K2 of chamber row KR2.

Figure 2:
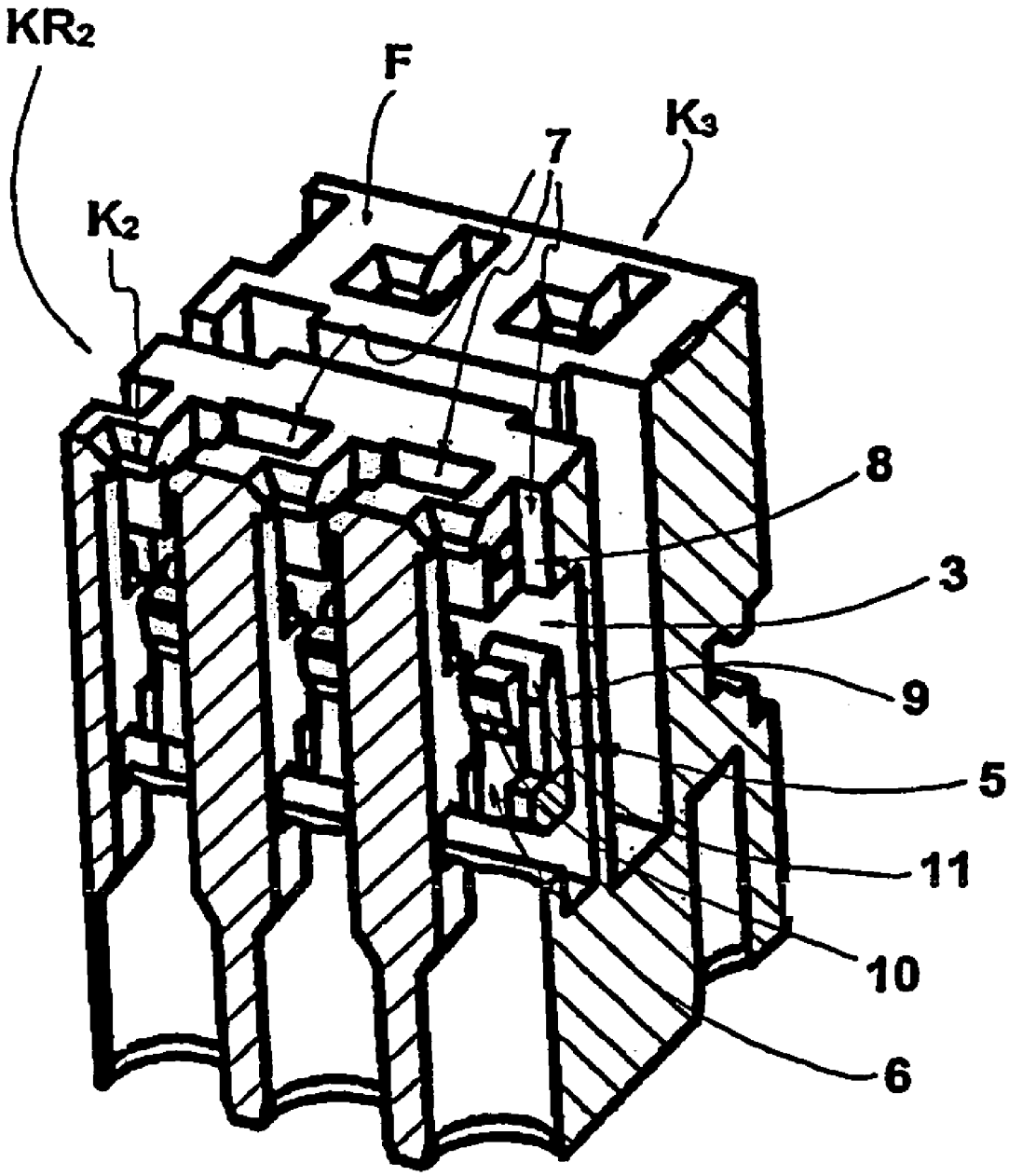
FIG. 2: is a cut-off block illustration which is a view into a few chambers of the middle chamber row of the chamber housing shown in FIG. 1.

As can be seen in FIG. 2, contact springs 6 are integrally molded on the wall sections separating each pair of adjacent chambers K2 of chamber row KR2. The necessary elasticity of contact springs 6 results from the material elasticity of the plastic used to produce chamber housing 1. Each contact spring 6 has, on its free, pliable end, a locking cam 10, which engages with an inserted contact element, for primary locking of it. Each contact spring 6 also has an unlocking slope 11. Unlocking slope 11 is inclined in the direction away from the assembly direction of a contact element to be inserted into a chamber K2, and therefore forms a contact surface for a removal tool inserted into wider section 8 of a separation channel 7 from front side F. Inserting such a tool undoes the primary locking provided by a contact spring 6 by moving the contact spring with its locking cam 10 out of its locking position, making it possible to change the contact element that is inserted into such a chamber K2. Here it is considered expedient to design the removal tool in such a way that it engages in two separation channels, in order to be able to act on the unlocking slopes arranged on both sides of locking cam 10. To accomplish this, each chamber K2 is connected with the two adjacent separation channels 7, at least in the area of its top section.

Figure 3:
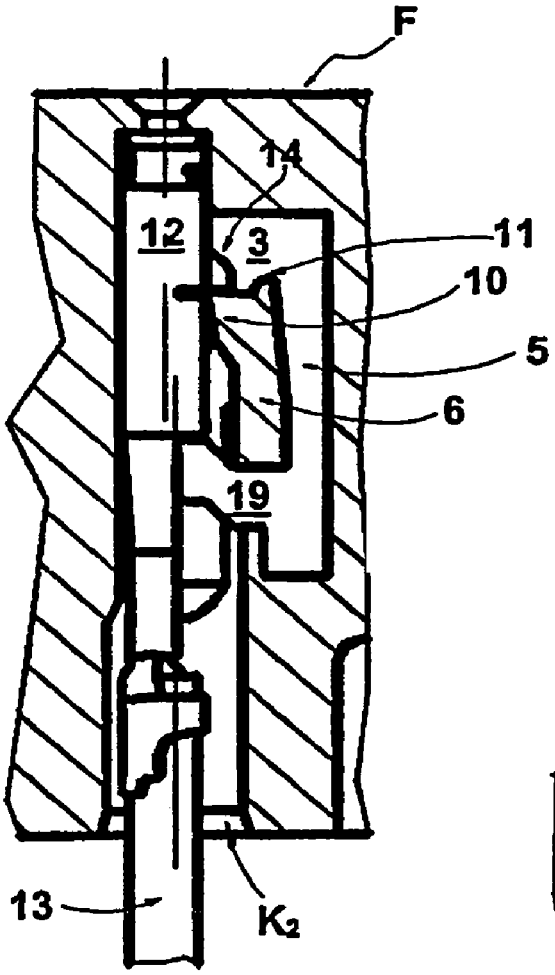
FIG. 3: is a section through a chamber of the middle chamber row of the chamber housing shown in FIG. 1 with an electrical contact element inserted in it.

FIG. 3 shows a cross section through a chamber K2 which has an electrical contact element 12 inserted into it with a cable 13 going away from its back. To secure the inserted contact element 12 against being pulled out in the direction away from the direction of assembly toward front side F, locking cam 10 of contact spring 6 engages behind a locking element 14 of contact element 12, which is intended to interact with locking cam 10. This effectively secures the contact element 12 inserted into chamber K2 against being pulled out. The representation in FIG. 3 also shows the upper tip of unlocking slope 11 of contact spring 6.

Chamber housing 1 also has a locking slider 15 associated with it. Locking slider 15 is fork-shaped and, in the sample embodiment shown, has three locking strips V1, V2, V3. The two outer locking strips V1, V3 provide secondary locking of contact elements inserted into chambers K1, K3 of chamber rows KR1, KR3. To accomplish this, locking strips V1, V3 engage into a respective locking channel 16, 17 along the longitudinal extension of chamber housing 1. Locking channels 16, 17 encroach into each chamber K1 and K3, respectively, and into a corresponding recess of a contact element inserted into such a chamber K1, K3.

Figure 4:
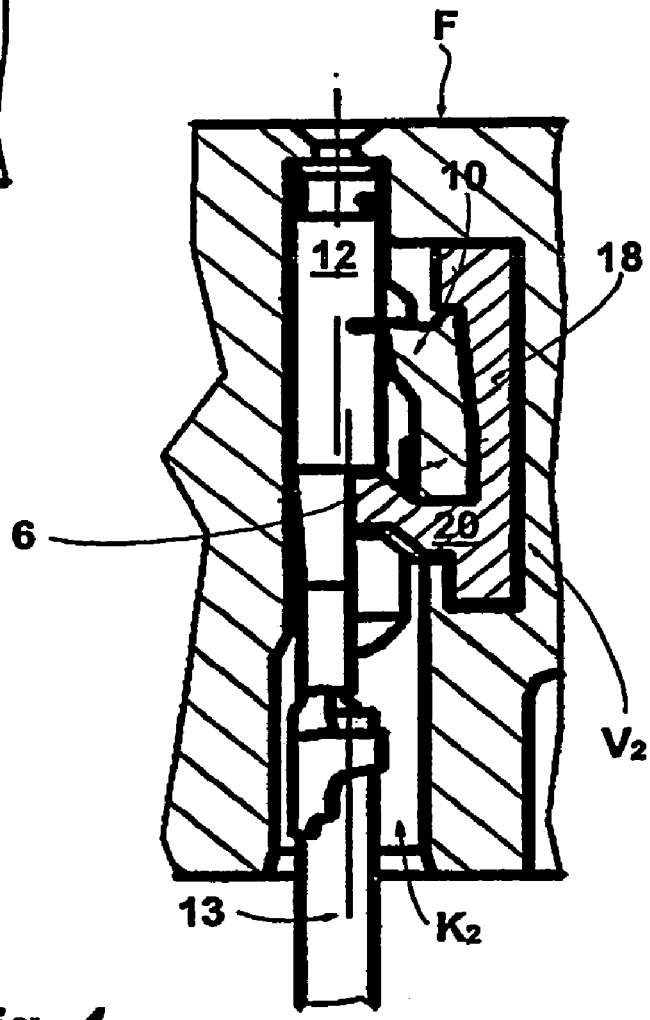
FIG. 4: is an illustration corresponding to FIG. 3 with a locking slider inserted into the chamber housing.

Middle locking strip V2 includes a top section 18, which has a small shoulder piece and which fills the cross-sectional surface of blocking channel 5 and some of the cross-sectional surface of slider channel 3, and it can be inserted into the common channel formed of slider channel 3 and blocking channel 5. Secondary locking of the contact elements inserted into chambers K2 of chamber row KR2—for example, contact element 12 in FIG. 3—is provided by a locking channel 19 which follows the longitudinal extension of chamber housing 1 and which encroaches into chambers K2 of chamber row KR2. This locking channel 19 can be seen in FIG. 3. Locking channel 19 opens into blocking channel 5, so that ultimately all longitudinal channels of middle chamber row KR3—channels 3, 5, and 19—form a common channel. This is expedient not only with respect to the tools that are required, but also with respect to the form of locking strip V2. After locking strips V1, V2, V3 are put into respective locking channels 16, 19, 17 by pushing locking slider 15 into chamber housing 1, all contact elements inserted into individual chambers K1, K2, K3 of the different chamber rows KR1, KR2, KR3 are secondarily locked. Section 18 of locking strip V2, which extends back behind contact springs 6 of middle chamber row KR3, additionally secures them against buckling. FIG. 4 shows locking strip V2 of locking slider 15 pushed into channels 3, 5, and 19. FIG. 4 shows both the buckling protection provided by section 18 of locking strip V2 and also the engagement of a locking leg 20 of strip V2 into the previously open channel 19. The free end of locking leg 20 engages into a corresponding open place in the contact element 12, thereby providing effective secondary locking.

LIST OF REFERENCE NUMBERS

1 Chamber housing
2 Contact spring
3 Slider channel
4 Transverse side
5 Blocking channel
6 Contact spring
7 Separation channel
8 Section of separation channel
9 Section of separation channel
10 Locking cam
11 Unlocking slope
12 Contact element
13 Cable
14 Locking element
15 Locking slider
16 Locking groove
17 Locking groove
18 Section
19 Locking groove
20 Locking leg
F Front side
K1-K3 Chamber
KR1-KR3 Chamber row
V1-V3 Locking strip

What is claimed is:

1. A housing of an electrical plug-and-socket connector, the housing comprising:

chambers arranged in parallel chamber rows, wherein the chamber rows include a middle chamber row between two outer chamber rows, wherein each chamber opens onto a front housing side to receive a contact element;

contact springs respectively associated with the chambers, wherein each contact spring has a locking element extending into the associated chamber for locking in place a contact element received by the associated chamber;

a slider channel beneath the front housing side, wherein the slider channel extends along the longitudinal extension of the middle chamber row, connects with the chambers of the middle chamber row, opens onto a transverse housing side, and borders top ends of the contact springs associated with the chambers of the middle chamber row;

separation channels respectively arranged between each pair of adjacent contact springs associated with the chambers of the middle chamber row, wherein the separation channels extend parallel to the longitudinal extension of the chambers of the middle chamber row, open onto a front housing side, and intersect the slider channel;

a blocking channel beneath the front housing side, wherein the blocking channel extends along the longitudinal extension of the middle chamber row, borders the contact springs associated with the chambers of the middle chamber row, and opens on the transverse housing side; and a slider insertable into the blocking channel, wherein the slider meets with the contact springs associated with the chambers of the middle chamber row when the slider is inserted through the blocking channel in order to prevent buckling of the contact springs associated with the chambers of the middle chamber row.

2. The housing of claim 1 wherein:

each chamber of the middle chamber row and the two separation channels arranged adjacent to said chamber connect with one another.

3. The housing of claim 1 wherein:

the slider channel and the blocking channel connect to form a common channel.

4. The housing of claim 3 wherein:

the slider is insertable into the common channel, wherein the slider meets with the contact springs associated with the chambers of the middle chamber row when the slider is inserted through the common channel in order to prevent buckling of the contact springs associated with the chambers of the middle chamber row.

5. The housing of claim 1 wherein:

each separation channel includes a wide section and a narrow section, wherein the wide section of each separation channel extends between the front housing side and the slider channel, wherein the narrow section of each separation channel extends from the slider channel away from the front housing side.

6. The housing of claim 5 wherein:

each contact spring associated with the chambers of the middle chamber row includes a sloped unlocking tab, wherein the tabs are reachable through the wide sections of the separation channels by a release tool in order to undo locking by the contact springs of contact elements received by the chambers of the middle chamber row.

7. The housing of claim 1 further comprising:

a locking channel beneath the front housing side, wherein the locking channel extends along the longitudinal extension of the middle chamber row and connects with the chambers of the middle chamber row, wherein the blocking channel and the locking channel connect to form a common channel.

8. The housing of claim 7 wherein:

the slider includes a locking strip, wherein the slider is insertable into the common channel, wherein the locking strip meets the contact elements received by the chambers of the middle chamber row when the slider is inserted through the common channel in order to lock in place the contact elements received by the chambers of the middle chamber row.

9. The housing of claim 1 further comprising:

locking channels beneath the front housing side, the locking channels respectively associated with the chamber rows, wherein each locking channel extends along the longitudinal extension of the associated chamber row and connects with the chambers of the associated chamber row.

10. The housing of claim 9 wherein:

the slider is a fork-shaped slider and is insertable into the blocking channel and the locking channels, wherein the slider meets the contact elements received by the chambers of the chamber rows when the slider is inserted through the blocking channel and the locking channels in order to lock in place the contact elements received by the chambers of the middle chamber row.

11. The housing of claim 10 wherein:

the slider is fixable in position after being inserted through the blocking channel and the locking channels.

12. A housing comprising:

a body having top and bottom sides, two transversely extending sides, and two longitudinally extending sides, wherein the body has a longitudinal extension extending between the transversely extending sides along the longitudinally extending sides;

chamber rows arranged side-by-side inside the body along the longitudinal body extension, wherein the chamber rows include at least one middle chamber row arranged between two outer chamber rows, wherein each chamber row includes chambers which extend between the top and bottom body sides and open onto the top body side for receiving a respective contact element;

contact springs arranged inside the body, wherein each contact spring extends into a respective chamber for locking in place a contact element received by the respective chamber, wherein each contract spring has a top end facing toward the top body side, a side end facing toward one of the longitudinally extending body sides, and a bottom end facing toward the bottom body side;

a slider channel arranged inside the body, wherein the slider channel extends adjacent to the middle chamber row along the longitudinal body extension, wherein the slider channel connects with the chambers of the middle chamber row, opens onto at least one of the transversely extending body sides, and borders the top ends of the contact springs which extend into the chambers of the middle chamber row;

separation channels respectively arranged inside the body between each pair of adjacent contact springs which extend into the chambers of the middle chamber row, wherein the separation channels extend between the top and bottom body sides, open onto the top body side, and intersect the slider channel;

a blocking channel arranged inside the body, wherein the blocking channel extends adjacent to the middle chamber row along the longitudinal body extension, borders the side ends of the contact springs which extend into the chambers of the middle chamber row, and opens onto the at least one of the transversely extending body sides; and a slider insertable through the at least one of the transversely extending body sides into the blocking channel, wherein when the slider is inserted through the blocking channel the slider encompasses the side ends of the contact springs which extend into the chambers of the middle chamber row in order to prevent buckling of these contact springs.

13. The housing of claim 12 wherein:

each chamber of the middle chamber row and the two separation channels arranged adjacent to said chamber connect with one another.

14. The housing of claim 12 further comprising:

locking channels inside the body, wherein the locking channels extend adjacent to respective chamber rows along the longitudinal body extension and connect with the chambers of the respective chamber rows;

wherein the slider is a fork-shaped slider and is insertable into through the at least one transversely extending body side through the blocking channel and the locking channels, wherein when the slider is inserted through the blocking channel and the locking channels the slider extends into the chambers of the respective chamber rows in order to lock in place contact elements received by said chambers.

15. The housing of claim 12 wherein:

the slider channel and the blocking channel connect to form a common channel.

16. The housing of claim 15 wherein:

the slider is insertable through the at least one of the transversely extending body sides into the common channel, wherein when the slider is inserted through the common channel the slider encompasses the side ends and at least a part of the top ends of the contact springs which extend into the chambers of the middle chamber row in order to prevent buckling of these contact springs.

17. The housing of claim 12 wherein:

each separation channel includes a wide section and a narrow section, wherein the wide section of each separation channel extends from the top body side to the slider channel, wherein the narrow section of each separation channel extends from the slider channel toward the bottom body side.

18. The housing of claim 17 wherein:

each contact spring associated with the chambers of the middle chamber row includes a sloped unlocking tab, wherein the tabs are reachable through the wide sections of the separation channels by a release tool in order to undo locking by the contact springs of contact elements received by the chambers of the middle chamber row.

19. The housing of claim 12 further comprising:

a locking channel inside the body, wherein the locking channel extends adjacent to the middle chamber row along the longitudinal body extension and connects with the chambers of the middle chamber row, wherein the blocking channel and the locking channel connect to form a common channel.

20. The housing of claim 19 wherein:

the slider includes a locking strip, wherein the slider is insertable through the at least one of the transversely extending body sides into the common channel, wherein when the slider is inserted through the common channel the locking strip extends into the chambers of the middle chamber row in order to lock in place contact elements received by said chambers.

* * * * *